US006840317B2

(12) United States Patent
Hirsch et al.

(10) Patent No.: US 6,840,317 B2
(45) Date of Patent: Jan. 11, 2005

(54) WIRELESS DOWNWHOLE MEASUREMENT AND CONTROL FOR OPTIMIZING GAS LIFT WELL AND FIELD PERFORMANCE

(75) Inventors: John Michele Hirsch, Houston, TX (US); George Leo Stegemeier, Houston, TX (US); James William Hall, Houston, TX (US); Robert Rex Burnett, Katy, TX (US); William Mountjoy Savage, Houston, TX (US); Frederick Gordon Carl, Jr., Houston, TX (US)

(73) Assignee: Shell Oil Company, Houston, TX (US)

( * ) Notice: Subject to any disclaimer, the term of this patent is extended or adjusted under 35 U.S.C. 154(b) by 11 days.

(21) Appl. No.: 10/220,455

(22) PCT Filed: Mar. 2, 2001

(86) PCT No.: PCT/US01/07003

§ 371 (c)(1),
(2), (4) Date: Aug. 29, 2002

(87) PCT Pub. No.: WO01/65056

PCT Pub. Date: Sep. 7, 2001

(65) Prior Publication Data

US 2003/0047308 A1 Mar. 13, 2003

Related U.S. Application Data

(60) Provisional application No. 60/186,377, filed on Mar. 2, 2000.

(51) Int. Cl.[7] ..... E21B 47/00; E21B 47/06

(52) U.S. Cl. ..... 166/250.15; 166/372

(58) Field of Search ..... 166/250.15, 250.01, 166/319, 372, 369, 66

(56) References Cited

U.S. PATENT DOCUMENTS 525,663 A 9/1894 Mottinger
2,917,004 A 12/1959 Davis et al.
3,083,771 A 4/1963 Chapman (List continued on next page.)

FOREIGN PATENT DOCUMENTS

| | | | |
|---|---|---|---|
| EP | 28296 | 5/1981 | ..... E21B/47/12 |
| EP | 295178 A2 | 12/1988 | ..... E21B/47/12 |
| EP | 339825 | 11/1989 | ..... E21B/47/12 |

(List continued on next page.)

OTHER PUBLICATIONS

Brown. Connolizo and Robertson, West Texas Oil Lifting Short Course and H.W. Winkler, "Misunderstood or overlooked Gas–Lift Design and Equipment Considerations," SPE, p. 351 (1994).

Der Spek, Alex, and Aliz Thomas, "Neural–Net Indentification of Flow Regime with Band Spectra of Flow–Generated Sound", SPE Reservoir Eva. & Eng.2 (6) Dec. 1999, pp. 489–498.

Sakata et al., "Performance Analysis of Long Distance Transmitting of Magnetic Signal of Cylindrical Steel Rod", IEEE Translation Journal on magnetics in Japan, vol. 8, No. 2. Feb. 1993,, pps. 102–106.

Otis Engineering, Aug. 1980, "Heavy Crude Lift System", Field Development Report, OEC 5228, Otis Corp., Dallas, Texas, 1980.

*Primary Examiner*—David Bagnell
*Assistant Examiner*—Daniel P Stephenson

(57) ABSTRACT

A method for optimizing the production of a petroleum well is provided. The petroleum well includes a borehole, a piping structure positioned within the borehole, and a tubing string positioned within the borehole for conveying a production fluid. Production of the well is optimized by determining a flow rate of the production fluid within the tubing string and determining a lift-gas injection rate for the gas being injected into the tubing string. The flow rate and injection rate data is communicated along the piping structure of the well to a selected location, where the data is collected and analyzed. After analysis of the data, an optimum operating point for the well can be determined.

31 Claims, 6 Drawing Sheets

U.S. PATENT DOCUMENTS 3,247,904 A 4/1966 Wakefield, Jr.
3,427,989 A 2/1969 Bostock et al.
3,566,963 A 3/1971 Blackledge ..... 166/189
3,602,305 A 8/1971 Kisling, III ..... 116/134
3,732,728 A 5/1973 Fitzpatrick ..... 73/151
3,793,632 A 2/1974 Still ..... 340/18
3,814,545 A 6/1974 Waters ..... 417/90
3,837,618 A 9/1974 Juhel ..... 251/129
3,980,826 A 9/1976 Widmer ..... 178/68
4,068,717 A 1/1978 Needham ..... 166/272
4,087,781 A 5/1978 Grossi et al. ..... 340/18
4,295,795 A 10/1981 Gass et al. ..... 417/111
4,393,485 A 7/1983 Redden ..... 367/25
4,468,665 A 8/1984 Thawley et al. ..... 340/856
4,545,731 A 10/1985 Canalizo et al. ..... 417/86
4,576,231 A 3/1986 Dowling et al. ..... 166/248
4,578,675 A 3/1986 MacLeod ..... 340/885
4,596,516 A 6/1986 Scott et al. ..... 417/58
4,630,243 A 12/1986 MacLeod ..... 367/82
4,648,471 A 3/1987 Bordon ..... 175/455
4,662,437 A 5/1987 Renfro ..... 166/65.1
4,681,164 A 7/1987 Stacks ..... 166/304
4,709,234 A 11/1987 Forehand et al. ..... 340/856
4,738,313 A 4/1988 McKee
4,739,325 A 4/1988 MacLeod ..... 340/854
4,839,644 A 6/1989 Safinya et al. ..... 340/854
4,886,114 A 12/1989 Perkins et al. ..... 166/65.1
4,901,069 A 2/1990 Veneruso ..... 340/853
4,972,704 A 11/1990 Wellington et al. ..... 73/155
4,981,173 A 1/1991 Perkins et al. ..... 166/66.4
5,001,675 A 3/1991 Woodward ..... 367/18
5,008,664 A 4/1991 More et al. ..... 340/854
5,130,706 A 7/1992 Van Steenwyk ..... 340/854
5,134,285 A 7/1992 Perry et al. ..... 250/269
5,160,925 A 11/1992 Dailey et al. ..... 340/853.3
5,162,740 A 11/1992 Jewell ..... 324/347
5,172,717 A 12/1992 Boyle et al. ..... 137/155
5,176,164 A 1/1993 Boyle ..... 137/155
5,191,326 A 3/1993 Montgomery ..... 340/855.5
5,230,383 A 7/1993 Pringle et al. ..... 166/66.4
5,246,860 A 9/1993 Hutchins et al. ..... 436/27
5,251,328 A 10/1993 Shaw ..... 455/73
5,257,663 A 11/1993 Pringle et al. ..... 166/66.4
5,267,469 A 12/1993 Espinoza ..... 73/40.5
5,278,758 A 1/1994 Perry et al. ..... 364/422
5,331,318 A 7/1994 Montgomery ..... 340/855.4
5,353,627 A 10/1994 Diatschenko et al. ..... 73/19.03
5,358,035 A 10/1994 Grudzinski ..... 166/53
5,367,694 A 11/1994 Ueno ..... 395/800
5,394,141 A 2/1995 Soulier ..... 340/854.4
5,396,232 A 3/1995 Mathieu et al. ..... 340/854.5
5,425,425 A 6/1995 Bankston et al. ..... 166/377
5,447,201 A 9/1995 Mohn ..... 166/375
5,458,200 A 10/1995 Lagerlef et al. ..... 166/372
5,467,083 A 11/1995 McDonald et al. ..... 340/854.6
5,473,321 A 12/1995 Goodman et al. ..... 340/854.9
5,493,288 A 2/1996 Henneuse ..... 340/854.4
5,531,270 A 7/1996 Fletcher et al. ..... 166/53
5,561,245 A 10/1996 Georgi et al. ..... 73/152.02
5,574,374 A 11/1996 Thompson et al. ..... 324/338
5,576,703 A 11/1996 MacLeod et al. ..... 340/854.4
5,587,707 A 12/1996 Dickie et al. ..... 340/870.09
5,592,438 A 1/1997 Rorden et al. ..... 367/83
5,662,165 A 9/1997 Tubel et al. ..... 166/250.01
5,723,781 A 3/1998 Pruett et al. ..... 73/152.18
5,730,219 A 3/1998 Tubel et al. ..... 66/250.01
5,745,047 A 4/1998 Van Gisbergen et al. 340/853.1
5,782,261 A 7/1998 Becker et al. ..... 137/155
5,797,453 A 8/1998 Becker et al. ..... 166/117.5
5,881,807 A 3/1999 Boe et al. ..... 166/100
5,883,516 A 3/1999 Van Steenwyk et al. .... 324/366
5,887,657 A 3/1999 Bussear et al. ..... 166/336
5,896,924 A 4/1999 Carmody et al. ..... 166/53
5,934,371 A 8/1999 Bussear et al. ..... 166/53
5,937,945 A 8/1999 Bussear et al.
5,941,307 A 8/1999 Tubel ..... 166/313
5,955,666 A 9/1999 Mullins ..... 73/52.18
5,959,499 A 9/1999 Khan et al. ..... 330/149
5,960,883 A 10/1999 Tubel et al. ..... 166/313
5,963,090 A 10/1999 Fukuchi ..... 330/149
5,971,072 A 10/1999 Huber et al. ..... 166/297
5,975,204 A 11/1999 Tubel et al. ..... 166/250.15
5,995,020 A 11/1999 Owens et al. ..... 340/854.9
6,012,015 A 1/2000 Tubel ..... 702/6
6,012,016 A 1/2000 Bilden et al.
6,070,608 A 6/2000 Pringle ..... 137/155
6,123,148 A 9/2000 Oneal ..... 166/118
6,148,915 A 11/2000 Mullen et al. ..... 166/278
6,192,983 B1 2/2001 Neuroth et al. ..... 166/250.15
6,208,586 B1 3/2001 Rorden et al. ..... 367/35
6,334,486 B1 1/2002 Carmody et al. ..... 166/53
6,484,800 B2 11/2002 Carmody et al. ..... 166/53

FOREIGN PATENT DOCUMENTS

EP 492856 A2 7/1992 ..... H04B/1/62
EP 641916 A2 3/1995 ..... E21B/33/124
EP 681090 A2 11/1995 ..... E21B/47/18
EP 697500 A2 2/1996 ..... E21B/49/00
EP 721053 A1 7/1996 ..... E21B/47/12
EP 732053 A1 9/1996 ..... A21C/9/04
EP 919696 A2 6/1999 ..... E21B/47/12
EP 922835 A2 6/1999 ..... E21B/43/14
EP 930518 A2 7/1999 ..... G01V/3/12
EP 0 964 134 A2 12/1999 ..... E21B/47/12
EP 0 972 909 A2 1/2000 ..... E21B/44/00
EP 999341 A2 5/2000 ..... E21B/33/124
FR 2677134 12/1992 ..... E21B/47/12
GB 2083321 A 3/1982 ..... H04B/5/00
GB 2325949 A 12/1998 ..... E21B/43/12
GB 2327695 A 2/1999 ..... E21B/43/12
GB 2338253 A 12/1999 ..... E21B/47/12
WO 80/00727 4/1980 ..... E21B/47/12
WO 93/26115 12/1993 ..... H04N/1/40
WO 96/00836 1/1996 ..... E21B/47/12
WO 96/24747 2/1996 ..... E21B/43/12
WO 97/16751 5/1997 ..... G01V/3/00
WO 97/37103 10/1997 ..... E21B/47/01
WO 98/20233 5/1998 ..... E21B/43/40
WO 99/60247 5/1999 ..... E21B/43/12
WO 99/37044 7/1999 ..... H04B/13/02
WO 99/57417 11/1999 ..... E21B/41/00
WO 00/04275 1/2000 ..... E21B/47/01
WO 00/37770 6/2000 ..... E21B/37/06
WO 01/20126 A2 3/2001 ..... E21B/43/12
WO 01/55555 A1 8/2001 ..... E21B/47/12

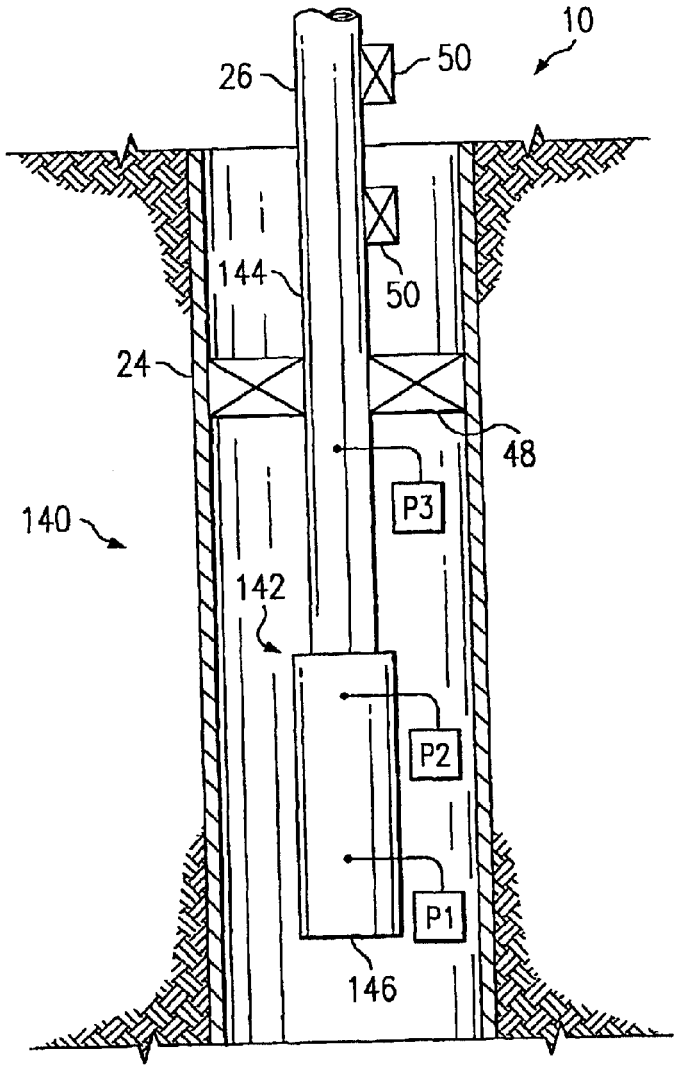
FIG. 4
FIG. 5
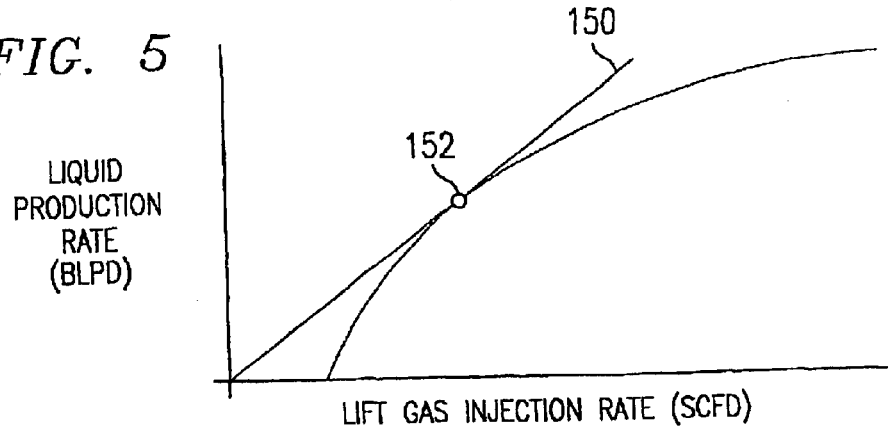

WIRELESS DOWNWHOLE MEASUREMENT AND CONTROL FOR OPTIMIZING GAS LIFT WELL AND FIELD PERFORMANCE

CROSS-REFERENCES TO RELATED APPLICATIONS

This application claims the benefit of the following U.S. Provisional Applications, all of which are hereby incorporated by reference:

COMMONLY OWNED AND PREVIOUSLY FILED U.S. PROVISIONAL PATENT APPLICATIONS

| T&K # | Ser. No. | Title | Filing Date |
|---|---|---|---|
| TH 1599 | 60/177,999 | Toroidal Choke Inductor for Wireless Communication and Control | Jan. 24, 2000 |
| TH 1600 | 60/178,000 | Ferromagnetic Choke in Wellhead | Jan. 24, 2000 |
| TH 1602 | 60/178,001 | Controllable Gas-Lift Well and Valve | Jan. 24, 2000 |
| TH 1603 | 60/177,883 | Permanent, Downhole, Wireless, Two-Way Telemetry Backbone Using Redundant Repeater, Spread Spectrum Arrays | Jan. 24, 2000 |
| TH 1668 | 60/177,998 | Petroleum Well Having Downhole Sensors, Communication, and Power | Jan. 24, 2000 |
| TH 1669 | 60/177,997 | System and Method for Fluid Flow Optimization | Jan. 24, 2000 |
| TS 6185 | 60/181,322 | A Method and Apparatus for the Optimal Predistortion of an Electromagnetic Signal in a Downhole Communications System | Feb. 9, 2000 |
| TH 1599x | 60/186,376 | Toroidal Choke Inductor for Wireless Communication and Control | Mar. 2, 2000 |
| TH 1600x | 60/186,380 | Ferromagnetic Choke in Wellhead | Mar. 2, 2000 |
| TH 1601 | 60/186,505 | Reservoir Production Control from Intelligent Well Data | Mar. 2, 2000 |
| TH 1671 | 60/186,504 | Tracer Injection in a Production Well | Mar. 2, 2000 |
| TH 1672 | 60/186,379 | Oilwell Casing Electrical Power Pick-Off Points | Mar. 2, 2000 |
| TH 1673 | 60/186,394 | Controllable Production Well Packer | Mar. 2, 2000 |
| TH 1674 | 60/186,382 | Use of Downhole High Pressure Gas in a Gas Lift Well | Mar. 2, 2000 |
| TH 1675 | 60/186,503 | Wireless Smart Well Casing | Mar. 2, 2000 |
| TH 1677 | 60/186,527 | Method for Downhole Power Management Using Energization from Distributed Batteries or Capacitors with Reconfigurable Discharge | Mar. 2, 2000 |
| TH 1679 | 60/186,393 | Wireless Downhole Well Interval Inflow and Injection Control | Mar. 2, 2000 |
| TH 1681 | 60/186,394 | Focused Through-Casing Resistivity Measurement | Mar. 2, 2000 |
| TH 1704 | 60/186,531 | Downhole Rotary Hydraulic Pressure for Valve Actuation | Mar. 2, 2000 |
| TH 1705 | 60/186,377 | Wireless Downhole Measurement and Control For Optimizing Gas Lift Well and Field Performance | Mar. 2, 2000 |
| TH 1722 | 60/186,381 | Controlled Downhole Chemical Injection | Mar. 2, 2000 |
| TH 1723 | 60/186,378 | Wireless Power and Communications Cross-Bar Switch | Mar. 2, 2000 |

The current application shares some specification and figures with the following commonly owned and concurrently filed applications, all of which are hereby incorporated by reference:

COMMONLY OWNED AND CONCURRENTLY FILED U.S. PATENT APPLICATIONS

| T&K # | Ser. No. | Title | Filing Date |
|---|---|---|---|
| TH 1601 | 10/220,254 | Reservoir Production Control from Intelligent Well Data | Aug. 29, 2002 |
| TH 1671 | 10/220,251 | Tracer Injection in a Production Well | Aug. 29, 2002 |
| TH 1672 | 10/220,402 | Oil Well Casing Electrical Power Pick-Off Points | Aug. 29, 2002 |
| TH 1673 | 10/220,252 | Controllable Production Well Packer | Aug. 29, 2002 |
| TH 1674 | 10/220,249 | Use of Downhole High Pressure Gas in a Gas-Lift Well | Aug. 29, 2002 |
| TH 1675 | 10/220,195 | Wireless Smart Well Casing | Aug. 29, 2002 |
| TH 1677 | 10/220,253 | Method for Downhole Power Management Using Energization from Distributed Batteries or Capacitors with Reconfigurable Discharge | Aug. 29, 2002 |
| TH 1679 | 10/220,453 | Wireless Downhole Well Interval Inflow and Injection Control | Aug. 29, 2002 |
| TH 1704 | 10/220,326 | Downhole Rotary Hydraulic Pressure for Valve Actuation | Aug. 29, 2002 |
| TH 1722 | 10/220,372 | Controlled Downhole Chemical Injection | Aug. 29, 2002 |
| TH 1723 | 10/220,652 | Wireless Power and Communications Cross-Bar Switch | Aug. 29, 2002 |

The current application shares some specification and figures with the following commonly owned and previously filed applications, all of which are hereby incorporated by reference:

COMMONLY OWNED AND PREVIOUSLY FILED U.S. PATENT APPLICATIONS

| | Ser. No. | Title | Filing Date |
|---|---|---|---|
| TH 1599US | 09/769,047 | Choke Inductor for Wireless Communication and Control | Oct. 20, 2003 |
| TH 1600US | 09/769,048 | Induction Choke for Power Distribution in Piping Structure | Jan. 24, 2001 |
| TH 1602US | 09/768,705 | Controllable Gas-Lift Well and Valve | Jan. 24, 2001 |
| TH 1603US | 09/768,655 | Permanent Downhole, Wireless, Two-Way Telemetry Backbone Using Redundant Repeater | Jan. 24, 2001 |
| TH 1668US | 09/768,046 | Petroleum Well Having Downhole Sensors, Communication, and Power | Jan. 24, 2001 |
| TH 1669US | 09/768,657 | System and Method for Fluid Flow Optimization | Jan. 24, 2001 |
| TS 6185 | 09/779,935 | A Method and Apparatus for the Optimal Predistortion of an Electro | Feb. 8, 2001 |

-continued

| COMMONLY OWNED AND PREVIOUSLY FILED U.S. PATENT APPLICATIONS | | |
|---|---|---|
| Ser. No. | Title | Filing Date |
| | Magnetic Signal in a Downhole Communications System | |

The benefit of 35 U.S.C. § 120 of the above referenced commonly owned applications. The applications referenced in the tables above are referred to herein as the "Related Applications."

BACKGROUND OF THE INVENTION

1. Field of the Invention

The present invention relates generally to a petroleum well, and in particular to a petroleum well having a downhole measurement and control system for optimally controlling production of the well or the field in which the well is situated.

2. Description of Related Art

Gas lift is widely employed to generate artificial lift in oil wells that have insufficient reservoir pressure to drive formation fluids to the surface. Gas is supplied to the well by surface compressors which connect through an injection control valve to the annular space between the production tubing and the casing. The gas flows down this annulus to a gas lift valve which connects the annulus between the tubing and the casing to the interior of the tubing. The gas lift valve is located just above the production zone, and the lift is generated by the combination of reduced density caused by gas bubbles in the fluid column filling the tubing, and by entrained flow of the fluids by the rising bubble stream.

A variety of flow regimes in the tubing are recognized, and are determined by the flow rate at the gas lift valve. The gas bubbles in the tubing decompress as they rise in the tubing since the head pressure of the fluid column above drops as the bubbles rise. This to determining the flow regime, such as fluid column height, fluid decompression causes the bubbles to expand, so that the flow regimes within the tubing vary up the tubing, depending on the volumetric ratio of bubbles to liquid. Other factors contribute composition and phases present, tubing diameter, depth of well, temperature, back pressure set by the production control valve, and physical characteristics of the surface collection system.

The rate of injection at the gas lift valve is determined by the pressure difference across the valve, and its orifice size. On the annulus side the pressure is determined by the gas supply flow rate and pressure at the surface connection. On the tubing interior side of the gas lift valve, the pressure is determined by a number of factors, notably the static head of the fluid column above the valve, the flow rate of fluids up the tubing, the formation pressure, and the inflow rate in the production zone. Conventionally the orifice size of the gas lift valve is preset by selection at the time the valve is installed, and cannot be changed thereafter without changing the valve, which requires that the well be taken out of production.

Generally speaking, production from a well increases monotonically and continuously as the injection rate of lift gas increases, but the lift efficiency measured as the ratio of produced liquids to lift gas used varies significantly as the flow regime changes, and becomes low at higher gas injection rates especially if annular flow is induced. The specific numerical relationship between gas injection rate and production rate varies significantly from well to well, and also evolves over time even for a specific well as fluids are withdrawn from the reservoir or inflow conditions from the formation change.

The ongoing supply of compressed lift gas is a major determinant of production cost. Thus the relationship between lift gas injection rate and liquid production rate for a specific well is important, since this determines the real cost of liquids delivered to the surface. Optimizing the lift gas injection rate to minimize production cost is thus of direct value, but generally this optimization can only be approximated since the relationship between injection rate and production rate cannot be monitored in real time, and since there is only an indirect relationship between annulus pressure, determined by lift gas injection rate, and the resulting volumetric gas flow rate at the gas lift valve.

The annulus between the surface and the gas lift valve comprises a large volume which acts as a reservoir of compressed gas. Consequently there is significant delay between changing the flow of lift gas at the surface, and the corresponding change in annulus pressure which determines the injection rate at the gas lift valve downhole. Surface measurements of fluid flow rates and composition also exhibit delays which may be of the order of hours, the transit time for fluids from the production zones to the wellhead. These sources of time latency effectively prevent real-time, closed-loop control of production using gas lift.

Gas lift exhibits an instability termed "heading" if the gas flow rate is lowered below a certain threshold in attempts to either conserve lift gas, or reduce production rate. Heading is caused by a positive-feedback interaction between bottom-hole pressure in the producing zone, and flow rate through the gas lift valve which is determined by the pressure differential between the annulus and the bottom-hole pressure. As the lift gas injection rate is reduced by lowering the annulus pressure, bottom-hole pressure increases as flow from the formation into the well dwindles. This increase in bottom-hole pressure reduces the pressure differential across the gas-lift valve, further reducing the lift gas injection rate and therefore further reducing the withdrawal rate of fluids from the formation. The consequence is cyclic "heading" or surging which eventually leads to cessation of all fluid flow and the death of the well.

An important issue with heading is that the long latency between changes in bottom hole conditions and their consequences as visible production rate fluctuations at the surface makes recovery from heading difficult once it has been initiated. The existing strategy to maintain flow stability is to hold the injection gas flow rate safely above the minimum which is expected to initiate heading, whether or not this leads to the desired production rate from the well.

Under conditions of very low reservoir production, it may become necessary to operate with intermittent gas lift in which gas injection is cyclic. In this mode the gas lift valve is completely closed at the start of the cycle, and reservoir flow into the tubing occurs through a check valve at or near the bottom of the tubing. After sufficient time has elapsed to allow the fluid level in the tubing to have risen above the lift gas valve, this valve is snapped open to allow fast injection of a gas bubble which drives the fluid above it up the tubing. When the slug of fluids has been ejected at the well head, the lift gas valve closes, and the cycle repeats. The check valve prevents produced fluids from being driven back into the formation during the lift phase of the cycle.

Intermittent gas lift is considered undesirable for a number of reasons. The intermittent demand for a high flow of lift gas is hard on compressors, which operate best against a steady demand. To mitigate this factor accumulators may be used to store gas awaiting the next lift cycle, but these are a capital cost item with ongoing maintenance, and at best a partial solution. The high intermittent flow requires oversize piping between the compressor station and the dependent wells, and the cyclic load on the piping is mechanically stressful.

It would, therefore, be a significant advance in the operation of petroleum wells if a real-time method for determining the gas lift injection rate and the production fluid flow rate were provided. It would also be a significant advance if real-time monitoring of "heading" conditions were provided.

All references cited herein are incorporated by reference to the maximum extent allowable by law. To the extent a reference may not be fully incorporated herein, it is incorporated by reference for background purposes and indicative of the knowledge of one of ordinary skill in the art.

SUMMARY OF THE INVENTION

The problems presented in determining real-time downhole conditions in order to optimize production and prevent heading are solved by the systems and methods of the present invention. In accordance with one embodiment of the present invention, a measurement system is provided to measure fluid flow through a main pipe. The measurement system includes a measurement section associated with the main pipe, the measurement section including a first pipe section and a second pipe section. The first pipe section has a smaller diameter than the second pipe section. The measurement system also includes a plurality of pressure sensors for measuring pressure data in the first and second pipe sections. A communication system is provided such that pressure data can be communicated along the main pipe.

In another embodiment of the present invention, a petroleum well having a borehole is provided. The petroleum well includes a tubing string disposed within the borehole, the tubing string being configured to convey a production fluid. A downhole measurement system is provided for determining a flow rate of production fluid within the tubing string, and a communication system is provided for communicating the flow rate data along a piping structure of the well. Under many circumstances, the piping structure will actually be the tubing string, but the piping structure could also comprise a casing located within the borehole of the well.

In another embodiment of the present invention, a method is provided for optimizing the production of a petroleum well. The petroleum well includes a borehole and tubing string positioned within the borehole for delivering production fluid. The flow rate of the production fluid within the tubing string is determined along with the lift-gas injection rate for lift-gas being injected into the tubing string. After collecting the flow rate and lift-gas injection rate data, it is communicated along a piping structure of the well to a selected location. At the selected location the data is analyzed to determine an optimum operating point for the well.

In another embodiment of the present invention, a method for optimizing the production of a petroleum field is provided, the petroleum field having a plurality of petroleum wells. As is typical with petroleum wells, each of the petroleum wells includes a borehole with a tubing string positioned within the borehole for conveying a production fluid (production well), or an injection fluid (injection well). In the case of a production well, the method first comprises the step of determining production fluids flow rate data and lift-gas injection rate data for each of the petroleum wells. In the case of an injection well, the method first comprises the step of determining inflow rate data for each of the wells. This data is then communicated along a piping structure of each well. In some cases, the piping structure may actually be the tubing string, and in other cases the piping structure may be a casing positioned within the borehole. All of the data is collected and analyzed to determine an optimum operating point for the petroleum field.

BRIEF DESCRIPTION OF THE DRAWINGS

FIG. 4 is a schematic of a downhole measurement system operably associated with the gas lift well of FIG. 1.

FIG. 5 is a graph illustrating a production curve for a single well, the production curve having an optimum operating point.

DESCRIPTION OF ILLUSTRATIVE EMBODIMENTS

Figure 1:
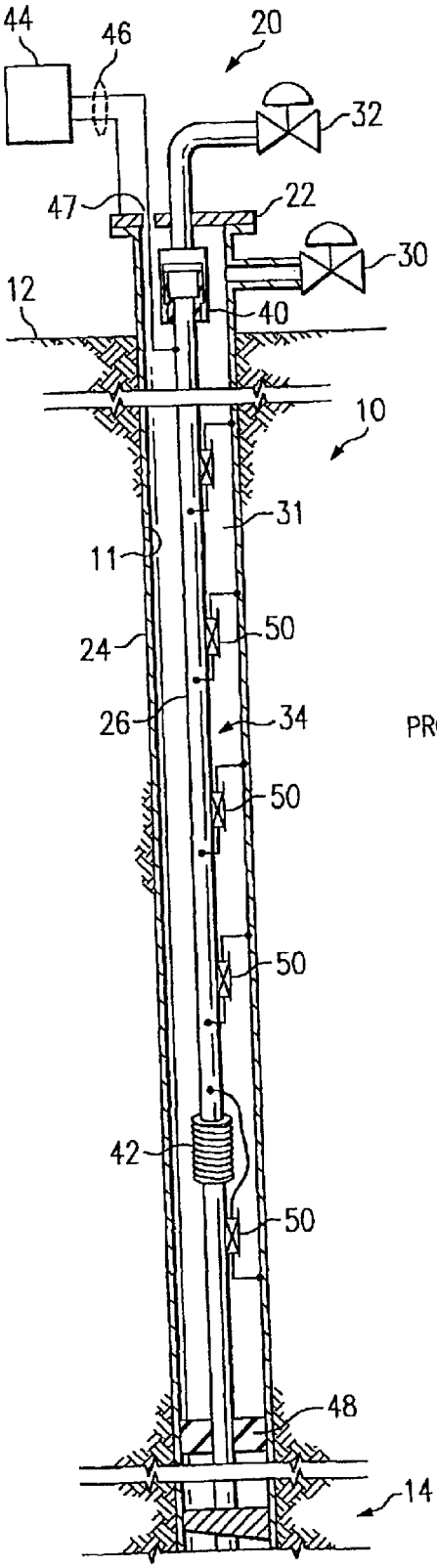
FIG. 1 is a schematic of a controllable gas lift well in accordance with a preferred embodiment of the present invention, the well having a casing and a tubing string positioned within a borehole of the well.

As used in the present application, a "piping structure" can be one single pipe, a tubing string, a well casing, a pumping rod, a series of interconnected pipes, rods, rails, trusses, lattices, supports, a branch or lateral extension of a well, a network of interconnected pipes, or other structures known to one of ordinary skill in the art. The preferred embodiment makes use of the invention in the context of an oil well where the piping structure comprises tubular, metallic, electrically-conductive pipe or tubing strings, but the invention is not so limited. For the present invention, at least a portion of the piping structure needs to be electrically conductive, such electrically conductive portion may be the entire piping structure (e.g., steel pipes, copper pipes) or a longitudinal extending electrically conductive portion combined with a longitudinally extending non-conductive portion. In other words, an electrically conductive piping structure is one that provides an electrical conducting path from one location where a power source is electrically connected to another location where a device and/or electrical return is electrically connected. The piping structure will typically be conventional round metal tubing, but the cross-sectional geometry of the piping structure, or any portion thereof, can vary in shape (e.g., round, rectangular, square, oval) and size (e.g., length, diameter, wall thickness) along any portion of the piping structure.

A "valve" is any device that functions to regulate the flow of a fluid. Examples of valves include, but are not limited to, bellows-type gas-lift valves and controllable gas-lift valves, each of which may be used to regulate the flow of lift gas into a tubing string of a well. The internal workings of valves can vary greatly, and in the present application, it is not intended to limit the valves described to any particular configuration, so long as the valve functions to regulate flow. Some of the various types of flow regulating mechanisms include, but are not limited to, ball valve configurations, needle valve configurations, gate valve configurations, and cage valve configurations. Valves can be mounted downhole in a well in many different ways, some of which include tubing conveyed mounting configurations, side-pocket mandrel configurations, or permanent mounting configurations such as mounting the valve in an enlarged tubing pod.

The term "modem" is used generically herein to refer to any communications device for transmitting and/or receiving electrical communication signals via an electrical conductor (e.g., metal). Hence, the term is not limited to the acronym for a modulator (device that converts a voice or data signal into a form that can be transmitted)/demodulator (a device that recovers an original signal after it has modulated a high frequency carrier). Also, the term "modem" as used herein is not limited to conventional computer modems that convert digital signals to analog signals and vice versa (e.g., to send digital data signals over the analog Public Switched Telephone Network). For example, if a sensor outputs measurements in an analog format, then such measurements may only need to be modulated (e.g., spread spectrum modulation) and transmitted—hence no analog-to-digital conversion is needed. As another example, a relay/slave modem or communication device may only need to identify, filter, amplify, and/or retransmit a signal received.

The term "processor" is used in the present application to denote any device that is capable of performing arithmetic and/or logic operations. The processor may optionally include a control unit, a memory unit, and an arithmetic and logic unit.

The term "sensor" as used in the present application refers to any device that detects, determines, monitors, records, or otherwise senses the absolute value of or a change in a physical quantity. Sensors as described in the present application can be used to measure temperature, pressure (both absolute and differential), flow rate, seismic data, acoustic data, pH level, salinity levels, valve positions, or almost any other physical data.

The term "electronics module" in the present application refers to a control device. Electronics modules can exist in many configurations and can be mounted downhole in many different ways. In one mounting configuration, the electronics module is actually located within a valve and provides control for the operation of a motor within the valve. Electronics modules can also be mounted external to any particular valve. Some electronics modules will be mounted within side pocket mandrels or enlarged tubing pockets, while others may be permanently attached to the tubing string. Electronics modules often are electrically connected to sensors and assist in relaying sensor information to the surface of the well. It is conceivable that the sensors associated with a particular electronics module may even be packaged within the electronics module. Finally, the electronics module is often closely associated with, and may actually contain, a modem for receiving, sending, and relaying communications from and to the surface of the well. Signals that are received from the surface by the electronics module are often used to effect changes within downhole controllable devices, such as valves. Signals sent or relayed to the surface by the electronics module generally contain information about downhole physical conditions supplied by the sensors.

Referring to FIG. 1 in the drawings, a petroleum well according to the present invention is illustrated. The petroleum well is a gas-lift well 10 having a borehole 11 extending from a surface 12 into a production zone 14 that is located downhole. A production platform 20 is located at surface 12 and includes a hanger 22 for supporting a casing 24 and a tubing string 26. Casing 24 is of the type conventionally employed in the oil and gas industry. The casing 24 is typically installed in sections and is cemented in borehole 11 during well completion. Tubing string 26, also referred to as production tubing, is generally conventional comprising a plurality of elongated tubular pipe sections joined by threaded couplings at each end of the pipe sections. It should be noted that tubing string 26 can be any conduit used to convey a production fluid. Production platform 20 also includes a gas input throttle 30 to permit the input of compressed gas into an annular space 31 between casing 24 and tubing string 26. Conversely, an output valve 32 permits the expulsion of oil and gas bubbles from an interior of tubing string 26 during oil production.

Gas-lift well 10 includes a communication system 34 for providing power and two-way communication downhole in well 10. Casing 24 and tubing string 26 act as electrical conductors for communication system 34. An insulating tubing joint 40 (also referred to as an electrically insulating joint) and a lower induction choke 42 are incorporated into the system to route time-varying current through these conductors. The insulating tubing joint 40 is incorporated close to the wellhead to electrically insulate tubing string 26 from casing 24. Thus, the insulating tubing joint 40 prevents an electrical short circuit between the lower sections of tubing string 26 and casing 24 at tubing hanger 22. Hanger 22 provides mechanical coupling and support of tubing string 26 by transferring the weight load of the tubing string 26 to the casing 24. In alternative to or in addition to the insulating tubing joint 40, another induction choke (not shown) can be placed about the tubing string 26 or an insulating tubing hanger (not shown) could be employed.

Lower induction choke 42 is attached about the tubing string 26 downhole above a packer 48 and serves as a series impedance to electric current flow. The size and material of lower induction choke 42 can be altered to vary the series impedance value; however, the lower induction choke 42 is made of a ferromagnetic material. Choke 42 is mounted concentric and external to tubing string 26, and is typically hardened with epoxy to withstand rough handling.

Centralizers fitted to the tubing string 26 between insulating tubing joint 40 and induction choke 42 are constructed and installed such that they do not create an electrically conductive path between tubing 26 and casing 11. Suitable centralizers may be composed of solid molded or machined plastic, or may be bow spring centralizers provided these are appropriately furnished with electrically insulating components. Many implementations of suitable centralizers will be apparent to those of ordinary skill in the art.

A computer and power source 44 having power and communication feeds 46 is disposed outside of borehole 11 at surface 12. Communication feeds 46 pass through a pressure feed 47 located in hanger 22 and are electrically coupled to tubing string 26 below insulating joint 40 of hanger 22. Power and communications signals are supplied to tubing string 26 from computer and power source 44.

A plurality of downhole devices 50 is electrically coupled to tubing string 26 between insulating joint 40 and lower induction choke 42. Some of the downhole devices 50 comprise controllable gas-lift valves. Other downhole devices 50 may comprise electronics modules, sensors, spread spectrum communication devices (i.e. modems), or conventional valves. Although power and communication transmission takes place on the electrically isolated portion of the tubing string, downhole devices 50 may be mechanically coupled above or below lower induction choke 42.

Figure 2:
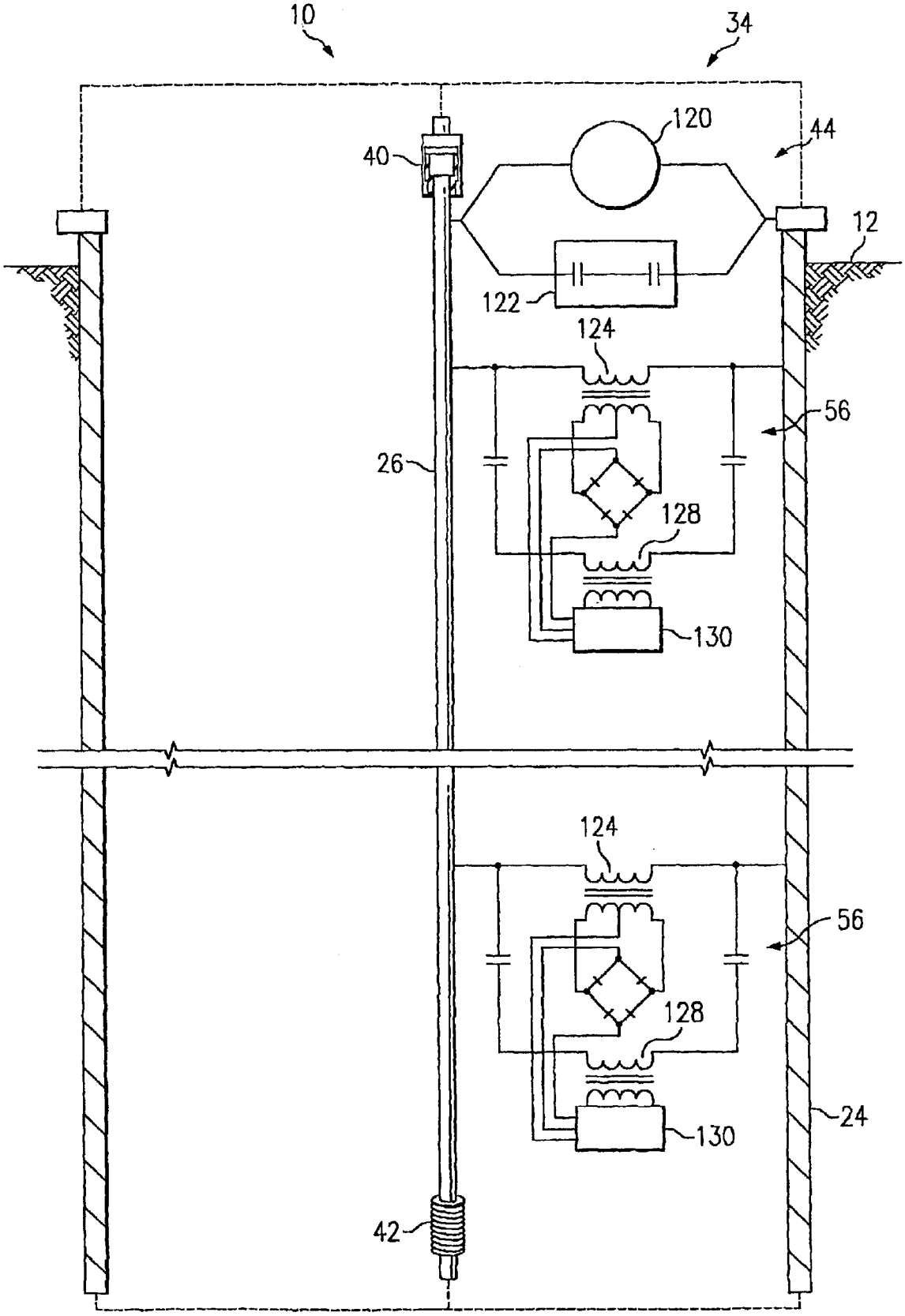
FIG. 2 is an electrical schematic of a communications system according to the present invention, the communications system being positioned within the borehole of the petroleum well of FIG. 1.

Referring to FIG. 2 in the drawings, communication system 34 is illustrated in more detail. Communication system 34 includes all of the components required to communicate along tubing string 26 and casing 24. One of these components, computer and power source 44, includes a power source 120 for supplying time-varying current and a master modem 122 electrically connected between casing 24 and tubing string 26. Two electronics modules 56 are connected to the tubing string 26 and the casing 24 downhole. Fewer or more electronics modules could be positioned downhole. Although electronics modules 56 appear identical, the modules 56 may contain or omit different components. A likely difference in each module could include a varying array of sensors for measuring downhole physical characteristics. It should also be noted that the electronics modules 56 may or may not be an integral part of a controllable valve. Each electronics module includes a power transformer 124 and a data transformer 128.

A slave modem 130 is electrically coupled to data transformer 128 and is electrically connected to tubing string 26 and casing 24. Slave modem 130 communicates information to master modem 122 such as sensor information received from electronics module 56. Slave modem 130 receives information transmitted by master modem 122 such as instructions for controlling the valve position of downhole controllable valves. Additionally, each slave modem 130 is capable of communicating with other slave modems in order to relay signals or information. Preferably the slave modems 130 are placed so that each can communicate with the next two slave modems up the well and the next two slave modems down the well. This redundancy allows communications to remain operational even in the event of the failure of one of the slave modems 130.

Figure 3:
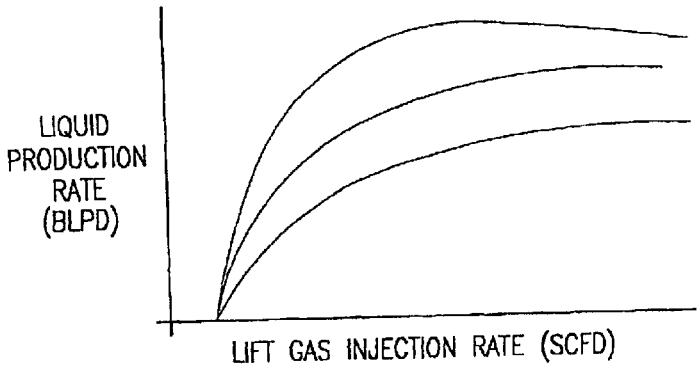
FIG. 3 is a graph illustrating a plurality of production curves for a gas lift well, the graph relating Liquid Production Rate on the ordinate axis to Lift Gas Injection Rate on the abscissa.

Referring to FIG. 3 in the drawings, production curves for a number of individual wells, or for separate production zones within a single well, are illustrated. The ordinate of this graph shows liquid production rate, typically measured in units of Barrels of Liquid per Day (BLPD), as a function of volumetric lift gas injection rate, typically measured in units of Standard Cubic Feet per Day (SCFD). Each zone or well has its own characteristic curve for the relationship between these measures, and there may be time variation in the curve for any particular zone or well. While it is possible to estimate these curves given tubing size, fluid viscosity and density, and depth for a particular zone, it is highly desirable to directly measure the curve for a zone or well rather than relying on estimates. By measuring the production curve at a given time for a given well, an optimum operating point for the well can be established.

Referring to FIG. 4 in the drawings, a downhole measurement system 140 is used to measure the production curve for petroleum well 10. Measurement system 140 includes all of the components necessary to measure the flow rate of production fluid within tubing string 26 and the lift gas injection rate. One of these components, a measurement section 142 of the tubing string 26, includes a first pipe section 144 and a second pipe section 146. The first pipe section 144 and the second pipe section 146 have differing diameters and contain a plurality of pressure sensors (P1, P2, and P3) disposed at intervals as illustrated. Typically this tubing configuration is placed below the lowermost producing gas lift valve 50 so that production fluids from the formation flow through the measurement section 142 of the tubing string 26 before gas bubbles enter the stream.

The production fluid flows at the same mass flow rate through both the first pipe section 144 (small diameter) and the second pipe section 146 (large diameter) of the tubing string 26. However, the differing diameters of the first pipe section 144 and the second pipe section 146 create a large difference in liquid flow velocity in the two pipe sections, and notably the head loss created by the flow is much greater in the first pipe section 144 than that in the second pipe section 146. The difference between pressures measured along the first pipe section 144 provides a measure of flow speed, but also includes a pressure difference due to the static head pressure differential between the sensors. This static head difference depends on the density of the liquid flowing from the formation, which cannot be determined a priori, and must be measured. This measurement is accomplished by the pressure sensors in the larger diameter section of pipe, where the pressure differential is dominated by the static head difference since the liquid flow velocity is low. Knowing the vertical rise between the pressure sensors in the larger diameter pipe section allows calculation of the liquid density.

The lowest pressure transducer effectively measures bottom hole pressure, an important and useful parameter for well characterization. Since the density is a measure of the ratio of oil to water in the produced liquids, this immediate measurement of the oil-water ratio at the moment the fluid is leaving the production zone has value for other diagnostic tests of the well operation such as rapid detection and determination of water intrusion into the well, and its variation with bottom hole pressure.

Alternative methods for measuring mass flow are feasible, such as differential temperature rise sensors, Doppler acoustic, vortex shedding or paddle-wheel flowmeters. The choice in practice depends on the value of the collateral data which becomes available with each sensor.

The volumetric gas flow through the gas lift valve (also referred to as the lift-gas injection rate) is derived from differential pressure measurement between the inlet and outlet of the valve coupled with pre-calibration of the valve to generate its flow curve as a function of opening, the $C_v$ curve of the valve. In practice the $C_v$ curve can be expected to change as the valve wears, but re-calibration at the expected relatively long intervals to account for valve wear is achieved by measuring long-term aggregate gas flow into the annulus at the surface using an orifice plate pressure differential. Alternatively the gas lift valve may be equipped with a mass flowmeter whose readings are transmitted to the surface, although at extra cost.

The well instrumentation as described allows control of production with augmented stability and economy in a variety of conditions. By transmitting production fluid flow rate data and lift-gas injection rate data from the above described instrumentation to the surface of the well, a production curve for the well can be established. This curve can then be used to determine an optimum operating point for the well.

Referring to FIG. 5 in the drawings, a production curve for a single well is illustrated. The production curve is measured at any particular instant in time by using the controllable gas lift valve 50 to vary the injection rate and measuring the flow rate of the production fluid. Such a measurement can be effected rapidly and effectively without impeding production, since the bottom-hole measurements avoid the time latency which would normally accompany a similar characterization using surface measurements. As measurements are made, data is transmitted from the down-hole location of the instrumentation to the surface over communications system 34 (see FIG. 1). With the production curve known, the point of most economical operation for the well can be determined by drawing a construction line 150 from the origin of the production curve to a point of tangential intersection with the production curve. The point at which the construction line 150 tangentially intersects the production curve is the optimum operating point 152 for the well. At the optimum operating point 152, an optimum lift-gas injection rate is given and the resulting flow rate for the production fluid at that injection rate can be determined. This simple method assumes that field compressor capacity is adequate to support the optimum lift-gas injection rate.

Figure 6:
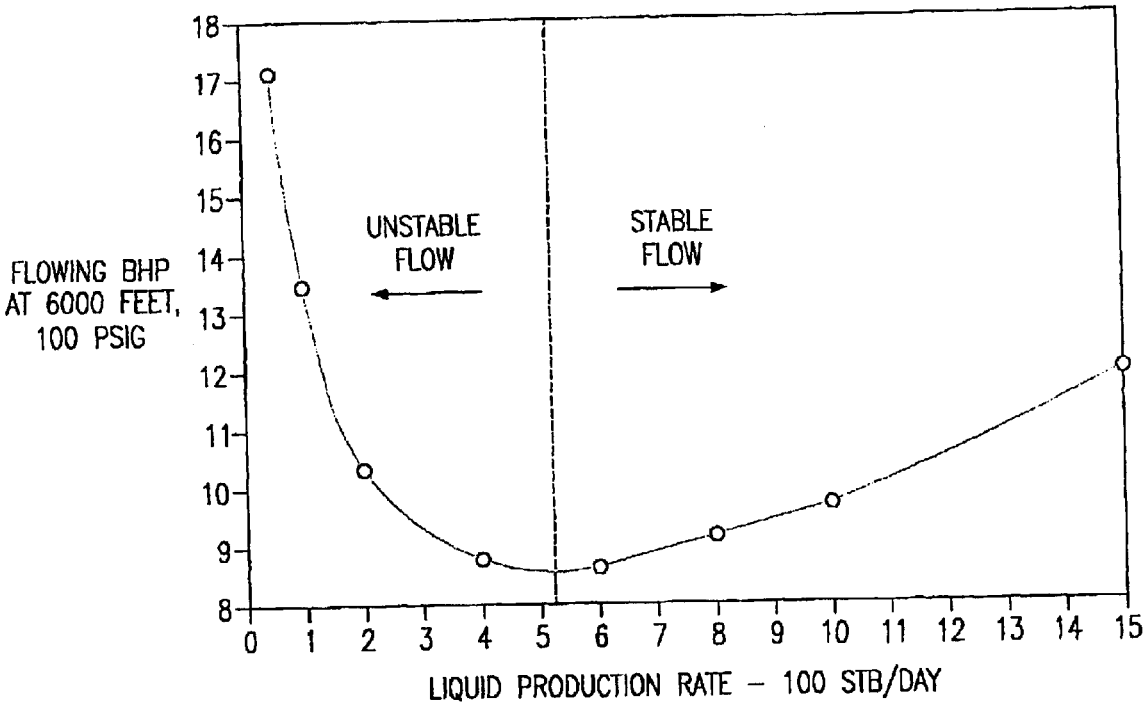
FIG. 6 is a graph relating Bottom Hole Pressure on the ordinate to Liquid Production Rate on the abscissa for a petroleum well.

Referring to FIG. 6 in the drawings, the relationship between Bottom Hole Pressure (shown on the ordinate) and liquid production rate (shown on the abscissa) is illustrated. The ability to measure bottom hole pressure and production fluid flow rate continuously and in real time allows the possibility for heading to be detected. The minimum point in this curve is the critical condition at which heading may be anticipated if the liquid production rate is reduced below this point. If this critical production rate is above the optimum production rate for minimum cost (i.e. optimum operating point 152 in FIG. 5), heading would be expected to occur, but can be controlled by using the gas lift valve 50 to allow constant volumetric flow. Under these conditions the gas lift valve 50 must be expected to variably open and close to maintain constant flow in the face of possible variations in Bottom Hole Pressure. Since Bottom Hole Pressure is continuously measured, this can assist in correctly cycling the lift gas valve.

Figure 7:
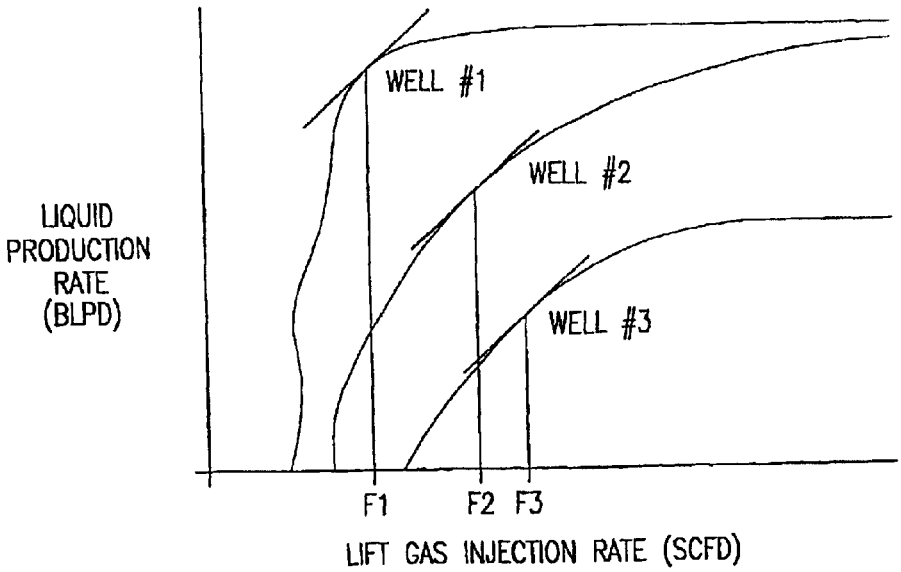
FIG. 7 is a graph of a plurality of production curves, each curve representing an individual petroleum well in a petroleum field, the graph showing the optimization of production performance based on analysis of all of the production curves.

Referring to FIG. 7 in the drawings, the production curves for three wells are illustrated. In practice, a field having a plurality of wells may operate with insufficient compressor capacity to maintain every well at the minimum production cost flow rate (i.e. optimum operating point 152 in FIG. 5). In this case the production curves for all the wells being lifted by the field compressors is required, but this data is easily and rapidly measured as previously described. To minimize aggregate field production cost, the optimum strategy is to operate each well such that it is at the same slope on the production curve. An optimum operating point on each curve has been chosen to have the same slope, and the aggregate lift gas usage F1+F2+F3 of the three wells is equal to the total capacity of the available field compressors. If the total compressor capacity changes either by removal of a compressor from service, or by the addition of further compressors, the immediate availability of the production curve data and the ability to alter the lift-gas injection rate allows dynamic management of the field. The result is the ability to maintain the most economical production with the resources available.

If intermittent gas lift is needed, either the Bottom Hole Pressure measurement or the production fluid flow rate measurement is used to trigger the opening of the gas lift valve. The closing of the gas lift valve may also be precisely timed since the completion of expulsion of the production fluid at the wellhead allows the appropriate command to be sent to the gas lift valve.

Figure 8A:
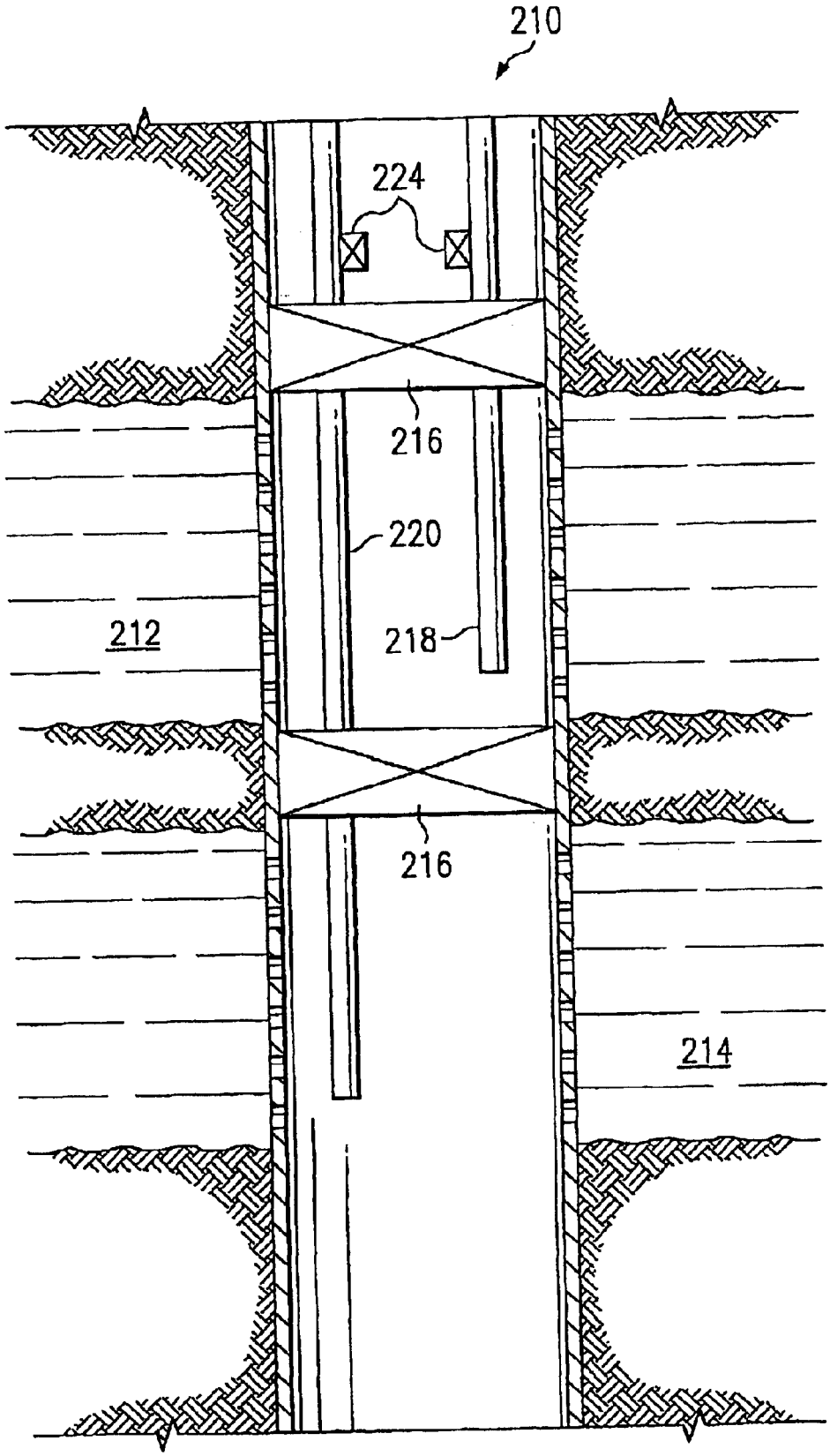
FIG. 8A is a schematic of a multiple zone gas lift well having features according to the present invention.

The present invention and its applications are not restricted to a single zone within a well, and may be implemented in a well that produces from multiple zones. Referring to FIG. 8A in the drawings, a well 210 using gas lift to produce from a first production zone 212 and a second production zone 214 is illustrated. Multiple packers 216 are used to maintain hydraulic isolation between the production zones 212, 214. A first tubing string 218 lifts production fluids from first production zone 212, and a second tubing string 220 lifts production fluids from second production zone 214. A gas lift valve 224 is disposed on each tubing string 218, 220 and is independently controlled from the surface of the well. In FIG. 8A, both gas lift valves 224 are placed above the upper packer 216 so that they accept input of lift gas from the annulus above the upper packer. Flow rate measurements of the production fluid would be taken individually for each tubing string 218, 220 in the production zone 212, 214 serviced by the tubing string.

Figure 8B:
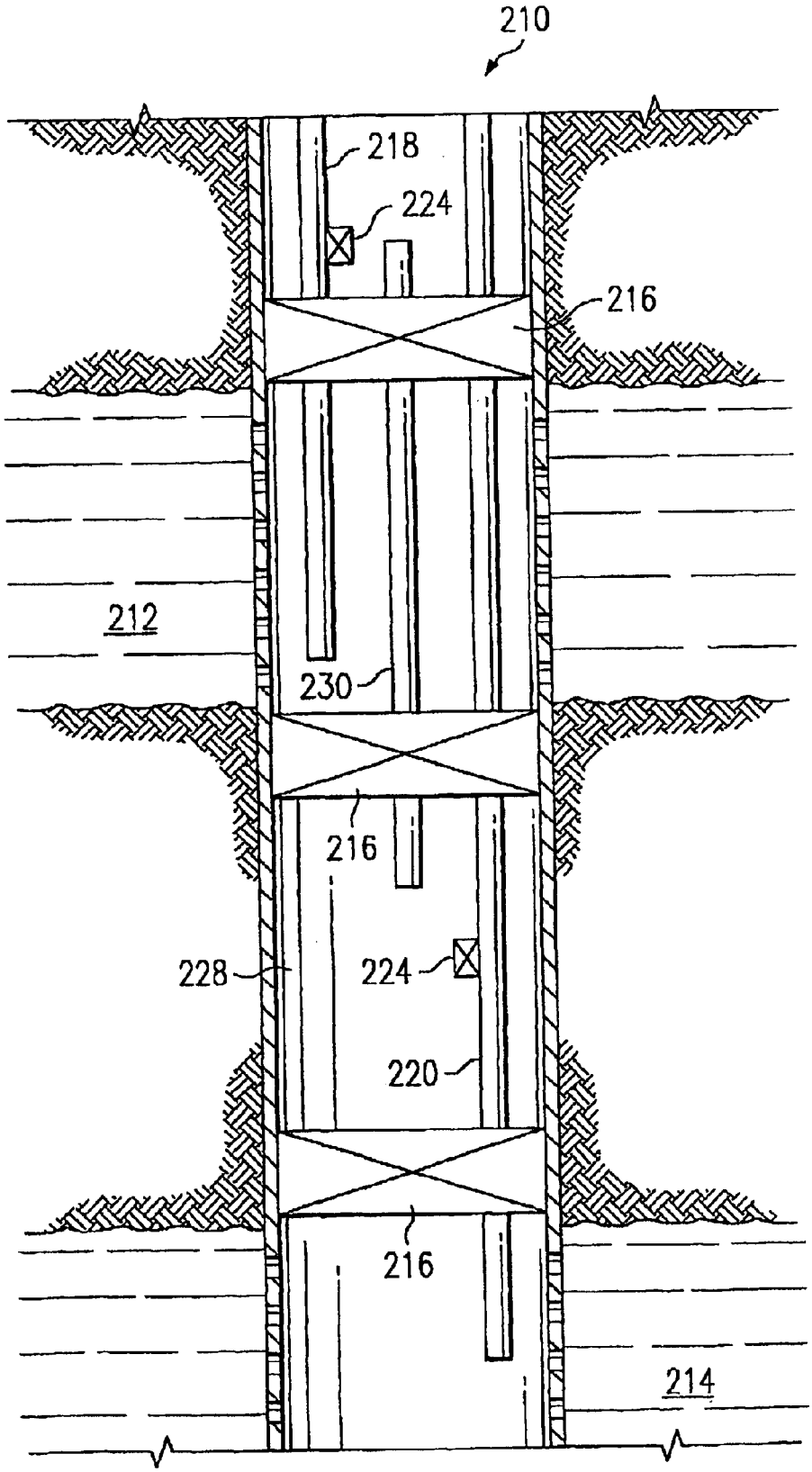
FIG. 8B is a schematic of a multiple zone gas lift well having features according to the present invention.

Referring to FIG. 8B in the drawings, an alternative arrangement for using the present invention within multiple-zoned wells is illustrated. In this configuration, a third packer 216 is added to create an intermediate zone 228 between first production zone 212 and second production zone 214. The gas lift valve 224 for second tubing string 220 is placed within intermediate zone 228, which is just above second production zone 214. Lift gas for the gas lift valve 224 of tubing string 220 is supplied to the intermediate zone 228 by a conveyance pipe 230, which is fluidly connected to the main annulus of the well.

Even though many of the examples discussed herein are applications of the present invention in petroleum wells, the present invention also can be applied to other types of wells, including but not limited to water wells and natural gas wells.

One skilled in the art will see that the present invention can be applied in many areas where there is a need to optimize flow within a borehole, well, or any other area that is difficult to access. Also, one skilled in the art will see that the present invention can be applied in many areas where there is an already existing conductive piping structure and a need to optimize flow by transmitting data along the piping structure. A water sprinkler system or network in a building for extinguishing fires is an example of a piping structure that may be already existing and may have a same or similar path as that desired for routing power and communications to an area where optimized flow is desired. In such case another piping structure or another portion of the same piping structure may be used as the electrical return. The steel structure of a building may also be used as a piping structure and/or electrical return for transmitting power and communications in accordance with the present invention. The steel rebar in a concrete dam or a street may be used as a piping structure and/or electrical return for transmitting power and communications in accordance with the present invention. The transmission lines and network of piping between wells or across large stretches of land may be used as a piping structure and/or electrical return for transmitting power and communications in accordance with the present invention. Surface refinery production pipe networks may be used as a piping structure and/or electrical return for transmitting power and communications in accordance with the present invention. Thus, there are numerous applications of the present invention in many different areas or fields of use.

It should be apparent from the foregoing that an invention having significant advantages has been provided. While the invention is shown in only a few of its forms, it is not just limited but is susceptible to various changes and modifications without departing from the spirit thereof.

We claim:

1. A method for optimizing the production of fluid in a petroleum well having a borehole and a piping structure positioned within the borehole, comprising the steps of:

determining a flow rate of the production fluid downhole in the borehole using a sensor positioned downhole in the borehole and powered using an AC signal applied to the piping structure as a conductor;

determining a lift-gas injection rate for an amount of lift-gas being injected into the well;

communicating the flow rate data and the lift-gas injection rate data; and collecting and analyzing the flow rate data and the lift-gas injection rate data to determine an optimum operating point for the petroleum well, wherein the step of determining the flow rate further comprises the steps of: measuring a first pressure of the production fluid within a first pipe section of the tubing string; measuring a second pressure of the production fluid within a second pipe section of the tubing string, the second pipe section being greater in diameter than the first pipe section; and determining the flow rate of the production fluid based upon the first pressure and the second pressure.

2. The method according to claim 1, further comprising the step of operating the well at the optimum operating point by selectively positioning a controllable gas lift valve powered using the piping structure as a conductor to control the amount of lift-gas injected into the piping structure.

3. The method according to claim 1, further comprising the step of operating the well at the optimum operating point by throttling the amount of lift-gas injected into the piping structure.

4. The method according to claim 1, wherein the step of collecting an analyzing further comprises the step of creating a production curve of the flow rate of the production fluid versus the lift-gas injection rate.

5. The method according to claim 1, wherein the lift-gas injection rate is determined by measuring the amount of lift-gas entering a tubing string through a controllable gas-lift valve.

6. The method according to claim 1, wherein the communicating step further comprises transmitting the flow rate data along the piping structure to a surface computer.

7. The method according to claim 1, wherein the communicating step further comprises transmitting the flow rate data to a controller positioned downhole in the borehole.

8. The method according to claim 1, wherein the piping structure is the tubing string.

9. The method according to claim 1, wherein the communicating step further comprises the steps of:

defining a transmission section of the piping structure using at least in part an impendance device positioned around the piping structure; and communicating the data along the transmission section of the piping structure.

10. The method according to claim 1, further comprising the step of operating the well to preventing heading.

11. The method for optimizing production of liquid in a petroleum field having a plurality of petroleum wells and a piping structure disposed within the borehole of a number of wells, comprising the steps of:

determining a flow rate for the production fluid within the piping structure of a number of the petroleum wells wherein the step of determining the flow rate further comprises the steps of: measuring a first pressure of the production fluid within a first pipe section of the tubing string; measuring a second pressure of production fluid within a second pipe section of the tubing string, the second pipe section being greater in diameter than the first pipe section; and determining the flow rate of the production fluid based upon the first pressure and the second pressure;

communicating the flow rate data along the piping to a surface computer for a number of the petroleum wells;

determining a lift-gas injection rate for an amount of lift-gas being injected into the piping structure of each of the petroleum wells;

communicating the lift-gas injection rate data to a surface computer for a number of the petroleum wells; and collecting and analyzing the flow rate data and lift-gas injection rate data supplied by each of the wells to determine an optimum operating point for the petroleum field.

12. The method according to claim 11, further comprising the step of operating the petroleum field at an optimum operating point by selectively controlling the amount of lift-gas injected into one or more wells.

13. The method according to claim 11, wherein the step of collecting and analyzing further comprises the step of creating a production curve of flow rate of the production fluid versus lift-gas injection rate for a number of the petroleum wells.

14. The method according to claim 11, wherein the lift-gas injection rate is determined by measuring the amount of lift-gas entering a tubing string through a controllable gas lift valve.

15. The method according to claim 11, wherein the piping structure is the tubing string.

16. The method according to claim 11, wherein the communicating step further comprises the steps of:

positioning an induction choke around the piping structure to define a transmission portion; and communicating the flow rate data along the transmission portion of the piping structure.

17. The method according to claim 11, including optimizing the field production based on a limited supply of lift gas.

18. The method according to claim 11, operating a number of wells in the field at approximately the same slope of a production curve of the flow rate of the production fluid versus the lift-gas injection rate.

19. A gas lift well comprising:

a tubing string positioned within the borehole for delivering a production fluid from downhole to the surface;

a downhole measurement system for determining a flow rate of the production fluid within the tubing string, wherein the downhole measurement system comprises: a measurement section disposed on the tubing string having a first pipe section and a second pipe section, wherein the first pipe section is lesser in diameter than the second pipe section; a plurality of pressure sensors, wherein at least one of the pressure sensors is configured to detect a first pressure of the production fluid in the first pipe section and at least one of the pressure sensors is configured to detect a second pressure of the production fluid in the second pipe section; and whereby data obtain by the pressure sensors is used to determine the flow rate of the production fluid within the tubing string;

a sensor for determining the lift gas injection rate; and a communication system operably associated with the tubing string such that flow rate data from the downhole measurement system can be communicated along the tubing string.

20. The petroleum well according to claim 19, including a controllable gas-lift valve operably connected to the tubing string and powered by a time-varying current applied to the tubing string.

21. The petroleum well according to claim 19, wherein the measurement system comprises two or more pressure sensors used to determine the flow rate of the production fluid within the tubing string.

22. The petroleum well according to claim 19, wherein two pressure sensors are configured to detect pressure data within the second pipe section, the pressure data being used to determine the density of the production fluid within the tubing string.

23. The petroleum well according to claim 19, wherein the measurement system further comprises a paddle-wheel flowmeter.

24. The petroleum well according to claim 19, wherein the measurement system further comprises differential temperature rise sensors.

25. The petroleum well according to claim 19, wherein the measurement system further comprises sensors for obtaining Doppler acoustic measurements.

26. The petroleum well according to claim 19, wherein the measurement system further comprises sensors for obtaining vortex shedding measurements.

27. The petroleum well according to claim 19, further comprising a controllable gas-lift valve operably attached to the tubing string to regulate an amount of lift gas injected into the tubing string, wherein the amount of lift-gas injected is based upon the flow rate data obtained from the downhole measurement system.

28. A petroleum well comprising:

a tubing string positioned within the borehole for delivering a production fluid from downhole to the surface;

a downhole measurement system for determining a flow rate of the production fluid within the tubing string;

a sensor for determining the lift gas injection rate;

a communication system operably associated with the tubing string such that flow rate data from the downhole measurement system can be communicated along the tubing string;

a current impedance device positioned around the tubing string, wherein flow rate data from the downhole measurement system is communicated along a portion of the tubing string defined at least in part by the current impedance device; and a controllable gas-lift valve operably attached to the tubing string for controlling a lift-gas injection rate for a lift-gas injected into the tubing string, wherein the optimum lift-gas injection rate for the well is determined from a production curve of the flow rate of the production fluid versus the lift-gas injection rate wherein:

the tubing string extends longitudinally within the borehole from a surface of the well to a production zone; and the current impendance device is an electrically insulated tubing hanger positioned at the surface of the well.

29. A petroleum field having a plurality of gas-lift wells comprising:

a source of compressed gas of a finite amount;

one or more of the wells including a downhole measurement system for determining the flow rate of the production fluid within the production tubing of a respective well, the tubing having a transmission section for communicating the flow rate data to the surface wherein the downhole measurement system comprises: a measurement section disposed on the tubing string having a first pipe section and a second pipe section, wherein the first pipe section is lesser in diameter than the second pipe section; a plurality of pressure sensors, wherein at least one of the pressure sensor is configured to detect a first pressure of the production fluid in the first pipe section and at least one of the pressure sensors is configured to detect a second pressure of the production fluid in the second pipe section; and whereby data obtained by the pressure sensors is used to determine the flow rate of the production fluid within the tubing string;

a surface communication system for collecting the flow rate data from respective wells; and a surface computer connected to the communication system for analyzing the flow rate data and determining an optimum production for each well based on the finite amount of compressed gas.

30. The petroleum field of claim 29, a number of the wells including a throttle for regulating the amount of compressed gas injected into a respective well.

31. The petroleum field of claim 29, a number of the wells including gas-lift valve attached to the tubing and controllable to regulate the amount of compressed gas injected into a respective well.

* * * * *